US005796216A

United States Patent [19]

Beasley

[11] Patent Number: 5,796,216

[45] Date of Patent: Aug. 18, 1998

[54] ELECTRONIC IGNITION ENHANCING CIRCUIT HAVING BOTH FUNDAMENTAL AND HARMONIC RESONANT CIRCUITS AS WELL AS A DC OFFSET

[75] Inventor: Denny Dee Beasley, Fairfield, Ohio

[73] Assignee: Delta Power Supply, Inc., Cincinnati, Ohio

[21] Appl. No.: 367,209

[22] PCT Filed: Jul. 16, 1993

[86] PCT No.: PCT/US93/06713

§ 371 Date: Mar. 31, 1995

§ 102(e) Date: Mar. 31, 1995

[87] PCT Pub. No.: WO94/03034

PCT Pub. Date: Feb. 3, 1994

[51] Int. Cl.[6] ..... H05B 37/02

[52] U.S. Cl. ..... 315/307; 315/224; 315/DIG. 7; 315/DIG. 4; 315/276

[58] Field of Search ..... 315/276, 282, 315/DIG. 4, DIG. 5, DIG. 7, 209 R, 224, 307, 291

[56] References Cited

U.S. PATENT DOCUMENTS

| | | | |
|---|---|---|---|
| 3,448,335 | 6/1969 | Gregory . | |
| 3,573,544 | 4/1971 | Zonis . | |
| 3,611,021 | 10/1971 | Wallace | 315/307 |
| 3,743,921 | 7/1973 | Legg et al. | 315/307 |
| 4,187,450 | 2/1980 | Chen . | |
| 4,233,558 | 11/1980 | Gaertner . | |
| 4,251,752 | 2/1981 | Stolz . | |
| 4,277,728 | 7/1981 | Stevens | 315/247 |
| 4,350,934 | 9/1982 | Spreadbury | 315/282 |
| 4,572,990 | 2/1986 | Leale et al. | 315/DIG. 7 |
| 4,686,427 | 8/1987 | Burke . | |
| 4,701,671 | 10/1987 | Stupp . | |
| 4,704,563 | 11/1987 | Hussey | 315/DIG. 7 |
| 4,954,754 | 9/1990 | Nilssen . | |
| 5,173,643 | 12/1992 | Sullivan et al. | 315/219 |
| 5,192,896 | 3/1993 | Qin | 315/219 |

*Primary Examiner*—Robert Pascal
*Assistant Examiner*—Michael Shingleton
*Attorney, Agent, or Firm*—Porter, Wright, Morris & Arthur

[57] ABSTRACT

A high frequency electronic ballast (128) having a transformer (104) in which the transformer (104) has a primary winding (106) which is coupled to a secondary winding (108) via a primary flux path (1) from which flux can be diverted by a secondary flux path (2) including an air gap (114) which can be adjustable. Use of the transformer (104) permits load operation from a rectified alternating current power source which can be compensated by a high frequency power supply (192) to present a favorable power factor to the alternating current supply.

25 Claims, 12 Drawing Sheets

ELECTRONIC IGNITION ENHANCING CIRCUIT HAVING BOTH FUNDAMENTAL AND HARMONIC RESONANT CIRCUITS AS WELL AS A DC OFFSET

BACKGROUND OF THE INVENTION

The present invention relates generally to energy management systems for electric loads. Utility of the invention is found in power supplies and in lamp ballasts, such as used in the operation of discharge lamps, such as high intensity discharge (HID) lamps. More particularly, a high frequency electronic ballast circuit responsive to a highly dynamic load is described. The ballast circuit includes a transformer having primary and secondary flux paths to vary the flux, linking a secondary winding coupling the ballast to a load; and, due to the varying flux linkage, the transformer also isolates the ballast-circuit from the operating dynamics of the load.

Discharge lamps such as fluorescent, mercury, metal halide and high pressure sodium lamps are popular sources of light because of their high efficiency in converting electrical energy into light. For the high efficiency operation of such lamps, a high efficiency ballast circuit must be provided. Likewise, there are many applications in which a power supply responsive to a highly dynamic load is required.

Due to the highly dynamic characteristics of operation of certain loads, which may change from an effective open circuit to a very low impedance close to zero in a matter of nanoseconds, for example, upon ignition of a HID lamp, high efficiency ballast circuits have been very expensive. The high costs of prior art high efficiency ballast circuits are due to the requirements of expensive circuitry for high speed current limiting with high power ratings, which are necessary to construct ballast circuits in accordance with conventional circuit designs.

Accordingly, there is a need for an improved ballast circuit which can survive the hostile conditions imposed by starting and running dynamic loads at high efficiencies, yet which utilizes low cost components, such that the cost of the improved ballast circuit is substantially reduced in comparison to currently available ballast circuits.

Power supplies in many applications also experience highly dynamic behaviour that requires complex control mechanisms to prevent variations in output voltages. To provide adequate control, many analog components are added to provide regulation in each needed output. The introduction of these analog regulators also introduces high losses, and therefore, results in low efficiency. The high losses in the output regulators also require large physical size to allow dissipation of the heat generated in analog regulators.

SUMMARY OF THE INVENTION

These ballast and power supply needs are met by the invention of the present application wherein a high frequency electronic ballast circuit includes a transformer having a primary winding which is coupled to a secondary winding via a primary flux path from which flux can be diverted by a secondary flux path including an air gap, preferably an adjustable air gap. For one mode of operation, a portion of the secondary winding is switched out of the circuit including a connected load. Alternately, for another mode of operation a resonance element is connected in circuit with the load and a load driver operated around the resonance frequency. The frequency of operation can be adjusted, manually or via a frequency control signal generated by a signal source or feedback loop, for power control and for stability. A conventional operating frequency of devices of this type is in the range of 20–30 Khz, although the invention is not so restricted and may be designed for operation in frequencies in much broader range, estimated to be between about 15 Khz and about 500 Khz.

Use of the transformer permits operation from a rectified alternating current power source which can be compensated by a high frequency power supply to present a favorable power factor to the alternating current power supply. The ballast circuit preferably includes catastrophic transient protection to extend life expectancy of the high frequency ballast circuit.

In accordance with one aspect of the present invention, a high frequency ballast circuit for operating a dynamic load, such as a discharge lamp, comprises a transformer having a primary winding and a variable flux linked secondary winding for connection to a load, or lamp. Driver means are connected to the primary winding for driving the transformer to operate the load, or a discharge lamp, connected to the secondary winding. The transformer comprises a primary flux path coupling the secondary winding to the primary winding and a secondary flux path having a higher magnetomotive force (MMF) drop than the primary flux path.

In one embodiment of the present invention, the secondary winding comprises first and second winding portions interconnected in series to one another at a common secondary winding intermediate tap. In this embodiment, the ballast circuit further comprises flux sensor means coupled to the secondary flux path and switch means for selectively connecting the driver means across the secondary winding, or only across one of the first and second winding portions. The switch control means is connected to the flux sensor means for operating the switch means as a function of the flux passing through the secondary flux path.

The secondary flux path includes an air gap to define the higher magnetomotive force drop. Preferably, the air gap is adjustable to enable selection of the higher magnetomotive force drop in the secondary flux path. In addition, an auxiliary air gap is provided adjacent at least a portion of the primary winding for better control of leakage fluxes and to optimize power output for any given transformer core size.

In another embodiment, a high frequency ballast circuit further comprises resonance means connected to the secondary winding of the transformer for defining resonance for the circuit including the secondary winding, the resonance means and a load. The resonance means may comprise a series resonant capacitor connected in series with the secondary winding and a discharge lamp for defining a series resonance frequency during operation of a connected discharge lamp. Alternately or in addition, the resonance means may comprise a shunt resonant capacitor connected in shunt across a connected discharge lamp for defining a shunt resonance frequency while a connected discharge lamp is extinguished.

In this embodiment, the driver means comprises oscillator means for setting an operating frequency for the load or lamp driver means. The oscillator means may be operated at a substantially fixed frequency. Alternately, the high frequency ballast circuit may further comprise frequency control means for setting an operating frequency for the oscillator means. The frequency control means may comprise manually adjustable circuitry, a frequency control signal source and/or a feedback loop connected to the oscillator means.

Feedback frequency control is particularly advantageous where the high frequency ballast circuit comprises an alternating current to high voltage direct current converter means for generating high voltage direct current power for the driver means. The frequency control means then, comprises a feedback loop from the converter means for varying the frequency of operation of the oscillator means as a function of variations in the high voltage direct current power.

In accordance with another aspect of the present invention, a high frequency ballast circuit is provided as a power supply for a load, such as for operating a discharge lamp or any other type of lamp or load requiring a dynamically responsive power source, and, comprises a transformer having a primary winding and a variable flux linked secondary winding for connection to a load. Driver means connected to the primary winding drives the transformer to the load, or lamp, connected to the secondary winding. Power supply means generate full-wave rectified power from a supply of alternating current power. The full-wave rectified power is used by the driver means for driving the transformer to operate a load connected to the secondary winding.

The transformer may further comprise an auxiliary winding with the ballast circuit further comprising a power storage capacitor. First rectifier means are connected between the auxiliary winding of the transformer and the power storage capacitor, and second rectifier means are connected between the power storage capacitor and the power supply means for conducting power from the power storage capacitor to the power supply means. This arrangement partially smooths the full-wave rectified power to improve the power factor for the power supply means.

The first rectifier means may comprise a half-wave rectifier circuit or a full-wave rectifier circuit for higher power requirements. The auxiliary winding is selected to generate a voltage on the power storage capacitor which is a fraction, for example, one-half, of a peak voltage of the supply of alternating current power. To provide extended life for the circuit, the power supply means may comprise catastrophic transient protection means for protecting the power supply from one catastrophic power surge over the lifetime of the ballast circuit.

The catastrophic transient protection may comprise a first varistor designed to protect against voltage surges exceeding a first defined voltage level. Fusible circuit means for opening at current levels above a first current level, connected in series with the first varistor, and the series combination being connected in shunt across an input for the supply of alternating current power are provided. A second varistor designed to protect against voltage surges exceeding a second defined voltage level greater than the first defined voltage level connected in shunt across the input for the supply of alternating current power is a further variation. The fusible circuit means may comprise a section of electrically conductive foil on a printed circuit board, preferably formed in a zig-zag or triangular wave pattern.

It is thus an object of the present invention to provide an inexpensive high frequency electronic ballast circuit which is responsive to a highly dynamic load, and for example, which can reliably withstand the hostile starting and running conditions of HID and other lamps; to provide an inexpensive high frequency electronic ballast circuit having a transformer having a primary winding and a variable flux linked secondary winding for connection to a load; to provide an inexpensive high frequency electronic ballast circuit which presents a favorable power factor to an alternating current power supply for the ballast circuit; and, to provide an inexpensive high frequency electronic ballast circuit including transient protection from a catastrophic power surge on an alternating current power supply for the ballast circuit.

Other objects and advantages of the invention will be apparent from the following description, the accompanying drawings and the appended claims.

Figure 22:
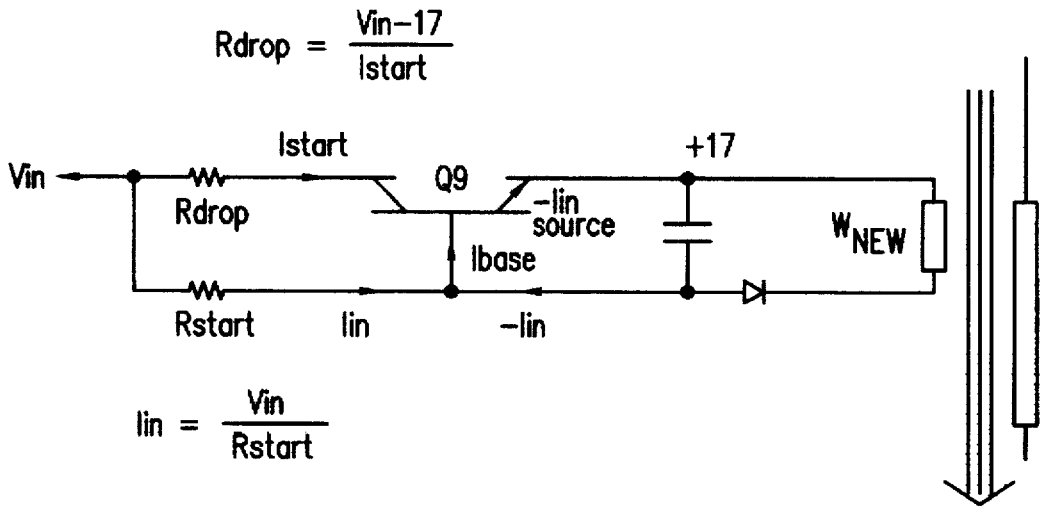

Operation of the start up circuit is shown in FIG. 22, in which the circuit transformer, as described above, is show as 22T with winding $^{W}$NEW. Pertinent circuit parameter equations are also included. $^{I}$in is present only when the ballast output stage is excited. The base current into Q4 is the summation of $^{I}$in and $^{-I}$in.

DETAILED DESCRIPTION OF THE INVENTION

Figure 1:
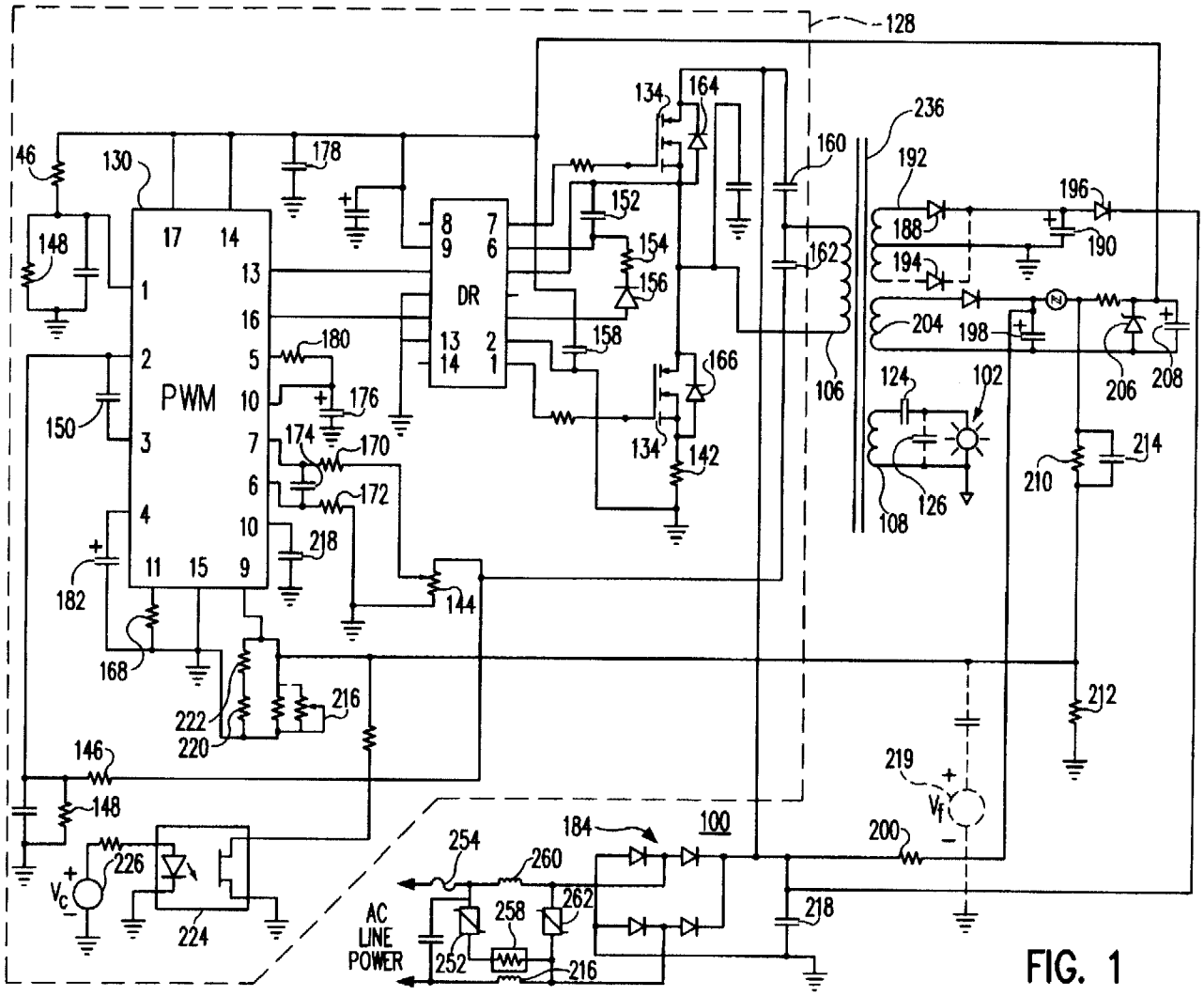
FIG. 1 is an electrical schematic diagram of a high frequency electronic ballast circuit for high intensity discharge lamps in accordance with the present invention.

A first illustrative embodiment of a high frequency electronic ballast circuit 100 in accordance with the present invention is schematically shown in FIG. 1. Before the operation of the ballast circuit 100 of FIG. 1 is described in detail, the transformer 104 for use in the ballast circuit 100 having a primary winding 106 and a variable flux linked secondary winding 108 will be described with reference to FIGS. 2–5.

In most transformers, the primary winding and the secondary winding are coupled as tightly as possible to provide maximum energy transfer under all conditions. For such maximum energy transfer, substantially all available flux couples the primary winding to the secondary winding. If the frequency and applied primary voltage are constant, the flux will have a constant peak and rate-of-change.

Figure 2:
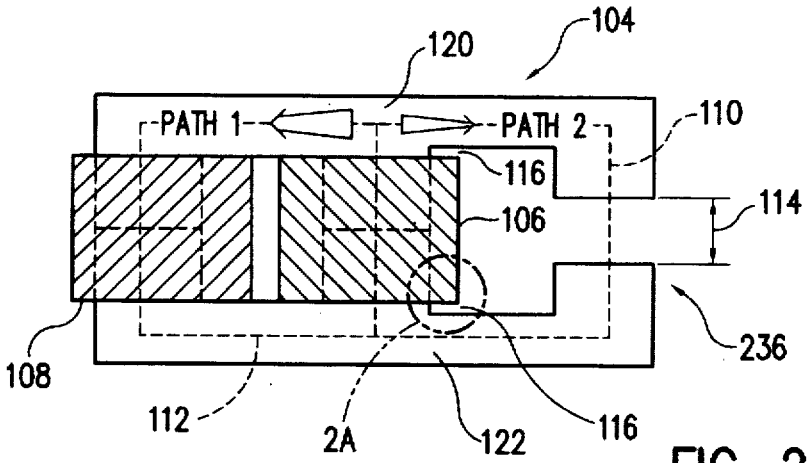
FIGS. 2–5 illustrate transformers having variably coupled secondary windings for use in the ballast circuit of FIG. 1.
Figure 3:
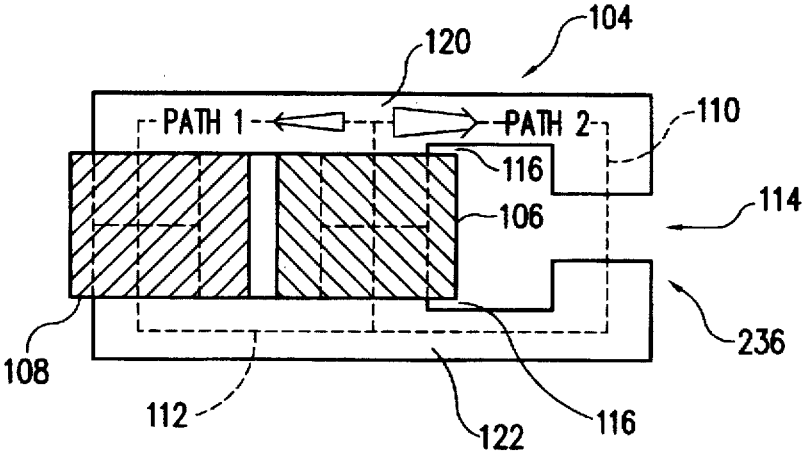

To make the secondary winding 108 variably coupled to the primary winding 106, a secondary flux path 110 having a higher magnetomotive force (MMF) drop than the principal flux path 112 is provided. One transformer configuration is shown in FIGS. 2 and 3 wherein path 1, the principal flux path 112, is the preferred flux path when no load is connected to the secondary winding 108, i.e., when the load or lamp 102 is nonconducting and thus on path 2, the secondary flux path 110, is an effective open circuit. Path 2, the secondary flux path 110, has a large air gap 114 with a high associated MMF drop.

Accordingly, nearly all of the flux generated by the primary winding 106 is coupled into the secondary winding 108 and the resulting induced voltage is at a maximum such that the peak voltage attains a value which will exceed the breakover voltage of the load or lamp 102. The arrow widths in FIGS. 2–3 are indicative of the relative magnitudes of magnetic flux in each path.

Figure 2A:
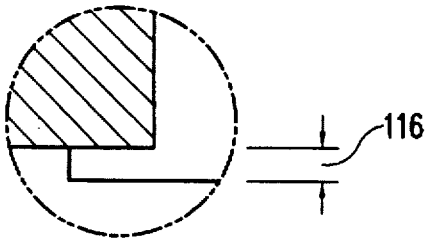

An auxiliary space or gap 116 may be provided adjacent to the primary winding 106 on the control path or secondary flux path 110, path 2 as shown in FIGS. 2 and 3. FIG. 2A further illustrates the auxiliary gap 116 that is contained in reference circle 2A. The auxiliary gap 116 provides better control of the leakage fluxes near the primary winding and optimizes power output for any given transformer core size.

At the moment of transition of a dynamic load, such as by the ignition of a lamp at 102, the MMF drop through the secondary winding 108 becomes very high as the load or lamp 102, immediately after ignition, is a very low impedance, closely approximating a short circuit. Because of this change in load impedance and MMF drop within path 1 (the principal flux path 112) of the transformer 104, path 2 (the auxiliary flux path 110) becomes a more attractive flux path.

The arrow widths in FIG. 3 schematically represent the division of flux through the transformer-core after dynamic loading, i.e., ignition of the lamp 102. The smaller flow of flux through the secondary that the voltage induced into the winding 108 illustrates that secondary winding 108 is much smaller than under the pre-ignition or no load condition. As the load or lamp 102 develops a higher impedance, the flux divides so as to increase the flux into path 1 and therefore the load or lamp voltage increases to match the higher impedance with a voltage that maintains a substantially constant current into the load 102. The air gap 114 shown in FIG. 2 controls the coupling strength for the secondary winding 108 and therefore the final equilibrated power delivered to the load 102.

The core of the transformer 104 can be manufactured with a specific dimension for the gap 114 to obtain a specific power level for the load 102. Alternately, the core configuration shown in FIG. 5 can be used wherein a moveable end piece 118 allows adjustment of power levels during preliminary ballast setup, or as a way of variably controlling the load power level over the lifetime of the ballast circuit 100, or in lamp applications, the lifetime of a given lamp load, such as lamp 102. For example, the moveable end piece 118 of the core of the transformer 104 of FIG. 5 permits selection of an air gap 114A or 114B with corresponding power levels.

In the illustrated embodiments of FIGS. 2–5, the transformer 104 is constructed using E-shaped cores 120 and 122. Other core configurations can be utilized in constructing transformers having variable flux linked secondary windings for use in the ballast circuit 100 as will be apparent to those skilled in the art. Further, placement of the primary 106 is not limited to the center leg of transformers using the E-shaped cores.

Figure 4:
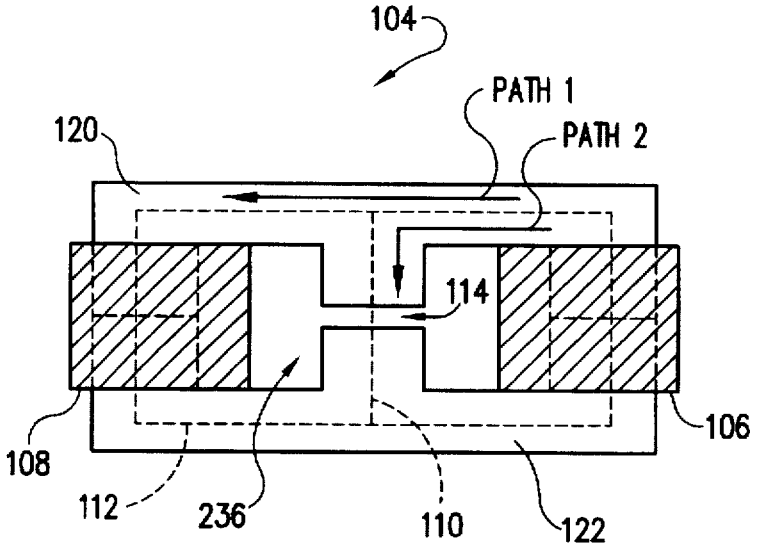

For example, FIG. 4 shows a transformer configuration wherein the primary and secondary windings 106 and 108 are on the outer legs of the transformer core with the control air gap 114 being formed on the center leg. The transformer configuration of FIG. 4 changes the two magnetic flux paths 110, 112 as shown. The configuration of FIG. 4 would provide better magnetic containment but would be more difficult to adjust during manufacture.

Figure 5:
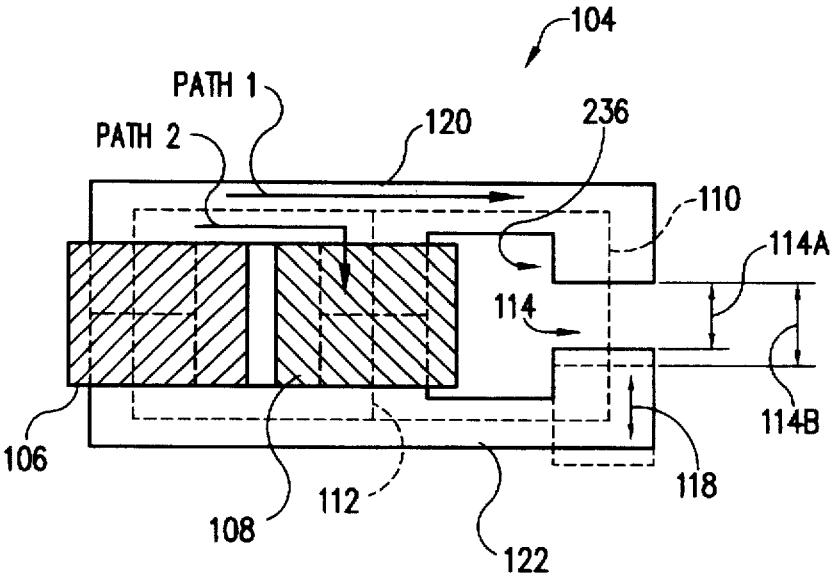

Alternately, the primary winding 106 can be on one outer leg, the secondary winding 108 on the center leg with the other outer leg including the control air gap 114 as shown in FIG. 5. A great variety of configurations beyond those illustrated will be apparent to those skilled in the art.

The operation of the high frequency electronic ballast circuit 100 of FIG. 1 including a transformer having a primary winding and a variable flux linked secondary winding will now be described. Two modes of operation, a resonant mode and a switched secondary mode, will be described with reference to FIGS. 1 and 6, respectively.

In FIG. 1, a capacitor 124 is connected between the variably flux linked secondary winding 108 and the lamp or load 102. The capacitor 124 resonates the load circuit during operation of the load 102 in a series resonant mode. The effective resistance of the load 102 controls the Q, quality factor, of the resonant condition to give the resonant response a broad frequency range between the half power points. Such a broad frequency range is significant because the normal variations in operating frequencies due to component and thermal variations can be as high as 3% to 6% which would cause severe out-of-tolerance operation if the load circuit had a high Q and narrow frequency range.

A capacitor 126 may be used to resonate the load circuit prior to application of a load, such as by ignition of a lamp at the load position, 102, to provide voltage and frequency peaking to accelerate ignition of the lamp 102. The frequency of the parallel resonance due to the capacitor 126 is higher than the frequency of the series resonance due to the capacitor 124. When used in a lamp application, the parallel resonance takes advantage of the inverse relationship of frequency to ignition voltage in gas lamps, i.e. the higher the frequency of voltage applied to a gas lamp, the lower the level of the voltage required for ignition of the lamp. Use of the parallel resonant capacitor 126 is not necessary or currently preferred for low wattage high frequency electronic ballast circuits of the present invention.

In the resonant mode of operation of the ballast circuit 100 of FIG. 1, the transformer 104 having a variably flux linked secondary winding 108 operates in what is referred to herein as a fully compliant mode. "Compliant" as used herein is the ability of a device to drive a load to deliver the needed voltage to allow the load to continue to operate under normal operating conditions. "Fully compliant" as used herein means that the device used to drive a load or lamp is able to first generate the high voltage required for a start or ignition, and then to drop to a low voltage during the warm up phase of operation, while preventing the lamp or load from extinguishing such that it must be once again ignited or restarted.

Driver means 128 is connected to the primary winding 106 for driving the transformer 104, the lamp 102 connected to the secondary winding 108. The driver means 128 can be any switching type drive circuit capable of driving the transformer 104 and lamp or load 102 at sufficiently high frequencies at or around 28.5 Khz. However, in the illustrated embodiment of FIG. 1, the driver means 128 comprises a pulse width modulation (PWM) circuit 130 which, in its simplest mode of operation, operates as an oscillator to control a driver circuit 132 which drives a pair of insulated gate bipolar transistors (IGBT's) 134, 136.

For example and as illustrated, the pulse width modulation (PWM) circuit 130 may comprise an SG3526 (commercially available from Motorola Corporation) and the driver circuit 132 may an IR 2110 integrated driver circuit (commercially available from the International Resistor Corporation). The use of the PWM circuit 130 permits frequency control or modulation of the drive signal for the lamp or load at 102 and back-up current and power controls for the ballast circuit 100.

For example, current through the primary winding 106 is sensed by monitoring the voltage across a current sensing resistor 142. The maximum current level is set by a potentiometer 144 which is connected to a current limit input on the PWM circuit 130. Current sample pulses from the sensing resistor 142 are also passed to resistors 146, 148 which determine the gain of an operational amplifier internal to the PWM circuit 130 and set up as an integrating/error amplifier. A capacitor 150 connected to the PWM circuit 130 integrates the current sample pulses into a direct current (DC) voltage level for comparison to a preset reference level to generate an error signal voltage. The preset reference level is generated by resistors 146, 148 which are selected to define ultimate lamp or load power through operation of the PWM circuit 130. While these controls are not utilized during normal operation of the ballast circuit 100, they can function to protect circuit elements in the event of failures within the circuit.

The illustrated driver circuit 132 provides level shifting in one drive such that only one drive needs to be referred to ground potential. The floating drive is attached to the transistor 136. Energy to operate the floating drive is stored on a capacitor 152 and is conducted through a resistor 154 and a diode 156. When the transistor 134 pulls its drain to ground potential, its source is nearly at ground level. Because the diode 156 is tied to a low voltage supply and the source of the transistor 136 is near ground level, the capacitor 152 will charge to the low voltage supply minus any voltage drops across the diode 156 and the transistor 136. The resistor 154 limits the rate of current rise to acceptable levels. The transfer of current pulses into the gates of the transistors 134, 136 require good bypassing at the drive circuit 132, which is accomplished by capacitors 152, 158.

The illustrated driver arrangement would be classified as a half-bridge configuration. The transistors 134, 136 are the active power switches and capacitors 160, 162 provide the passive coupling to complete the drive configuration. Diodes 164, 166 provide for the inductive return of energy stored in the inductances of the transformer 104.

The operation of the driver arrangement is as follows:

1) The transistor 134 receives drive voltage and saturates.
2) Current flows through the capacitor 160, the primary winding 106 of the transformer 104, and then to the drain of the transistor 134.
3) The driver terminates in the transistor 134.
4) Current flow transfers to the diode 164 as the transistor 134 turns off, and begins to decay.
5) A length of dead time will occur with the dead time being set by the resistor 168 connected to the PWM circuit 130. The dead time allows each of the transistors 134, 136 to fully turn off before the next one turns on.
6) The transistor 136 now receives drive voltage and saturates.
7) Current flows through the capacitor 162, reverses in the primary winding 106 of the lamp transformer 104, and then the drain of the transistor 136.
8) The drive terminates in the transistor 136.
9) Current flow transfers into the diode 166 as the transistor 136 turns off, and begins to decay.
10) After the dead time, the transistor 134 begins the cycle once again.

Resistors 170, 172 with a capacitor 174 filter the sampled current pulses to remove unwanted transients that could cause a false current trip. Capacitors 176, 178 bypass an internal reference source and the low voltage supply, respectively. A resistor 180 maintains a reset input of the PWM circuit 130 high to enable normal operation. A capacitor 182 controls the ramp-on rate of the pulse output from the start-up condition.

One aspect of the high frequency ballast circuit 100 of the present invention is that it can be operated by an unfiltered or other uneven input voltage. The reason it may be desirable to operate with an unfiltered input voltage is that the use of such an input voltage substantially prevents line pulse current and associated poor power factors when a rectified input voltage is filtered to obtain a clean DC voltage. Two approaches to use of an unfiltered input voltage are disclosed herein.

In FIG. 1, a full-wave bridge rectifier 184 is illustrated. A capacitor 186 is sized to perform noise reduction but not any appreciable level of energy storage. The waveform of the resulting output voltage accordingly is a full-wave rectified sine wave which is used to power the drive arrangement for the transformer 104 described above. When such an input voltage signal is used, the lamp or other load at 102 is maintained in its conductive state by the variable flux coupled secondary winding 108 of the transformer 104 as previously described.

As the voltage falls, the flux coupling the primary winding 106 to the secondary winding 108 remains relatively constant at very close to the zero crosspoint, thus maintaining stable operation. Unfortunately, direct use of the full-wave rectified sine wave as the input drive voltage places high dynamic constraints on the design of the magnetics and thus requires a larger transformer core cross-sectional area than would be required if the input voltage source was well filtered. This problem can be corrected by use of an auxiliary high voltage drive arrangement which will next be described.

Reference should also be made to FIGS. 7–11 in addition to FIG. 1 for the following description.

Figure 7:
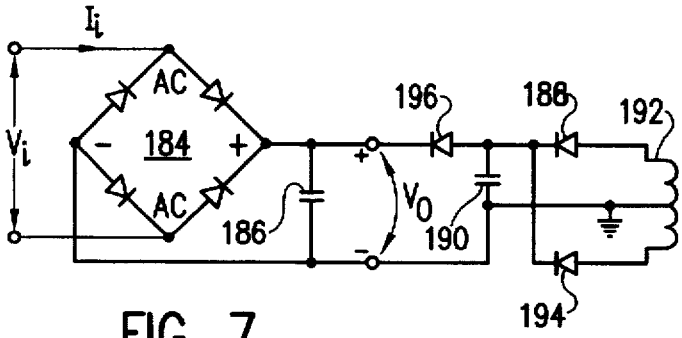
FIG. 7 is an electrical schematic diagram of power input and processing circuitry of the ballast circuit of FIG. 1.
Figure 8:
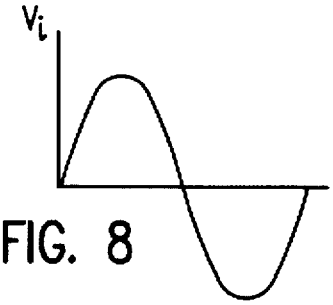
FIGS. 8–11 are waveforms of signals within the schematic diagram of FIG. 7.

FIG. 7 illustrates a portion of power supply means used in the ballast circuit 100 while FIGS. 8–11 show waveforms within the portion of the power supply means of FIG. 7. A power rectifying diode 188 and a capacitor 190 are connected to an auxiliary winding 192 of the transformer 104. The voltage output from the auxiliary winding 192 is selected to be less than the peak of the input voltage level of the AC line power, preferably about half, and is rectified by the diode 188 and stored by the capacitor 190. Dependent upon the power level of the electronic ballast circuit 100, a second rectifying diode 194 can be provided for full-wave rectification. See FIGS. 1 and 7. A diode 196 isolates the capacitor 190 from the capacitor 186 when the line voltage is higher than the auxiliary source voltage developed on the capacitor 190. This has the effect at the line of introducing a small harmonic distortion, less than 104, and achieves a power factor of 88%–92%.

Figure 9:
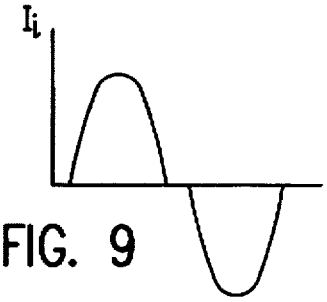
Figure 10:
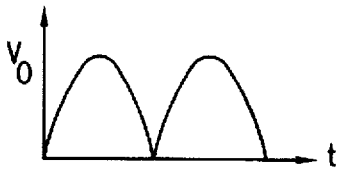
Figure 11:
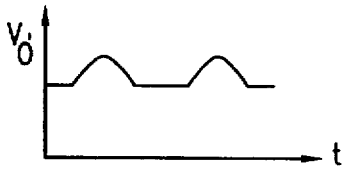

The waveform of the input current I, shown in FIG. 9 is typical of the kind of distortion that is expected when the DC power generated by the high frequency output from the auxiliary winding 192 is combined with the full-wave rectified signal $V_O$, shown in FIG. 10, generated by the full-wave bridge rectifier 184. FIG. 11 shows the resulting voltage waveform $V_O$, on the high voltage DC rail of the ballast circuit 100. While the result is substantially less than complete filtering, its effect minimizes the magnetic design so that the design is no worse than if the DC rail voltage is well filtered. The size of the capacitor 190 is substantially smaller than the capacitor that would be needed if the DC rail supply was filtered in a conventional manner. The energy stored on the capacitor 190 is supplied during times when the absolute, value of the input line voltage is less than the voltage on the capacitor 190.

In the resonant mode of operation, the capacitive reactance and the inductive reactance of the lamp or load circuit (the capacitor 124, the secondary winding 108 and the load 102) sum to zero at the resonant frequency providing an impedance minima or a current maxima. Operation precisely at resonance is not desirable since the resulting impedance is that of the lamp or load resistance only and will produce a square wave current in the output stage. It is currently preferred to operate the ballast circuit 100 at a frequency just below resonance with a resulting effective impedance that is capacitive in nature. Such operation produces, in effect, an electrical-inertial voltage source that at any instance must be summed with the DC rail voltage to obtain the net drive voltage.

Figure 12:
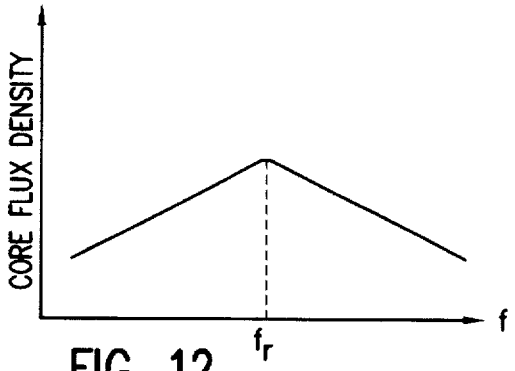
FIGS. 12–15 illustrate operation of a ballast circuit in a resonant model.

Operation of the ballast circuit on the lead side of resonance leads to the flux density in the core increasing with increasing frequency up to the resonant frequency $f_r$ as shown in FIG. 12. This positively sloping frequency to flux density curve permits the preferred operation of the ballast circuit in the resonant mode. Since the flux density is a positive function of frequency and voltage up to the resonance frequency $f_r$, the drive frequency can be modulated to keep the core flux density substantially constant in spite of ripple on the DC rail high voltage.

Figure 13:
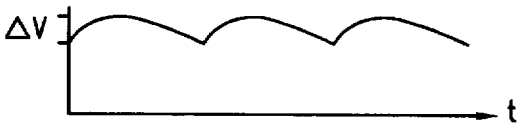
Figure 14:
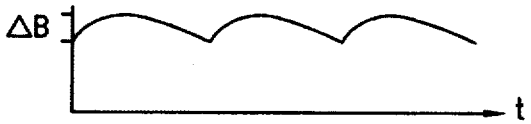
Figure 15:
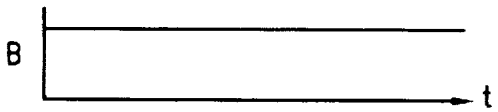

The high voltage of the DC rail is shown in FIG. 13 with the ripple voltage indicated by $\Delta V$. The variation in flux density with no control of the lamp or load drive frequency by feedback is shown in FIG. 14 and is indicated by $\Delta B$. As shown in FIG. 15, the core flux density is maintained at a substantially constant level by controlling the frequency of the lamp or load drive signal in response to feedback from the power supply of the ballast circuit 100. The core flux density can be held constant over a large range of DC rail variations.

Generation of a feedback signal is performed from the low voltage power supply such that the feedback signal is reduced in amplitude yet proportional to the ripple on the high voltage rail.

The low voltage supply also forms a part of the present invention and its operation will now be described prior to completing the description of the frequency control of the ballast circuit 100.

When AC line power is applied to the ballast circuit 100, a capacitor 198 is charged through a resistor 200. Once the voltage on the capacitor 198 reaches approximately 20 volts, a silicon bilateral switch 202 becomes conductive and remains conductive until the ballast circuit 100 is turned off. The power stored in the capacitor 198 sustains operation until voltage is induced in a low voltage secondary winding 204 to sustain normal operation. Current flows through the silicon bilateral switch 202 and a resistor 205 to the parallel combination of a zener diode 206 and energy storage capacitor 208, which serve to maintain a supply of low voltage power having a voltage level defined by the zener diode 206.

As shown in FIG. 1, resistors 210, 212 and capacitor 214 are used to generate the feedback signal for frequency control within the ballast circuit 100. The capacitor 198 acts as an integrator of the cycle to cycle current charging the capacitor 214. The junction of the resistors 210 and 212 is connected to the timing control pin 9 of the PWM circuit 130. As the voltage rises at the unregulated side of the resistor 205, the frequency of the drive signal for the ballast circuit 100 is reduced thereby substantially canceling the effect of the increasing driving voltage on the core flux density. Conversely, the frequency of the drive signal is increased as the voltage falls.

The relationship between the frequency of the drive signal in the ballast circuit 100 and the flux density in the core of the transformer 104 as shown in FIG. 12 is thus seen as providing a means for controlling power delivered to the lamp or load 102 by frequency control within the ballast circuit 100. While the feedback from the resistors 210, 212 provides an automatic control of the frequency of the drive signal as earlier noted with reference to FIGS. 13–15, frequency control can also be initially calibrated using a potentiometer 216 in combination with a capacitor 218.

Figure 16:
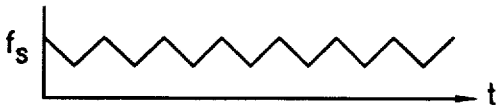
FIG. 16 is a sawtooth waveform for a frequency control 25 signal source of FIG. 1.

The frequency of the drive signal can also be continuously varied about a given operating frequency for ensuring a stable arc at the given operating frequency. For such continuous frequency variation, a frequency control signal source 219 can be provided alone or together with the feedback frequency control as previously described. The signal source 219 is shown in dotted lines in FIG. 1 since it is optional for the ballast circuit 100. One waveform which can be used for the signal source 219 is illustrated in FIG. 16 as a triangular or sawtooth waveform $f_s$ and should have a frequency greater than the AC power line frequency but less than the operating frequency of the ballast circuit 100.

Temperature compensation is preferably performed using a series combination of a resistor 220 and a temperature compensated resistor 222 sold commercially under the trademark "Tempsistor" by Midwest Components, Inc. Finally, frequency control can be performed manually, for example to control the load power level, by means of an optoisolator 224 which can be controlled via a voltage control device 226. An appropriate optoisolator can be selected from a family of optoisolators commercially available as the "HllF" family.

As previously noted, other control functions on the PWM circuit 130 are now used for limiting purposes only. Components connected to pins 1, 2 and 3 are used as an average current limit control to limit the maximum power attainable by the ballast circuit 100. Current limiting inputs on pins 6 and 7 are used as a backup for limiting the average drive current for the transformer 104.

An alternate mode of operation is performed by a modified version of the ballast circuit of FIG. 1. For ease of illustration and description, only the modification to the circuit of FIG. 1 is illustrated and described herein with reference to FIG. 6. As with the resonant mode of operation, this alternate mode of operation makes the transformer 104A fully compliant by inserting a large inductance in series with the lamp at the load position 102. While making operation fully compliant, unfortunately it also creates a triangular current waveform in the output stage which is not ideal and will not allow the output stage to produce the maximum power throughput given the current ratings of the transistors 134, 136.

Figure 6:
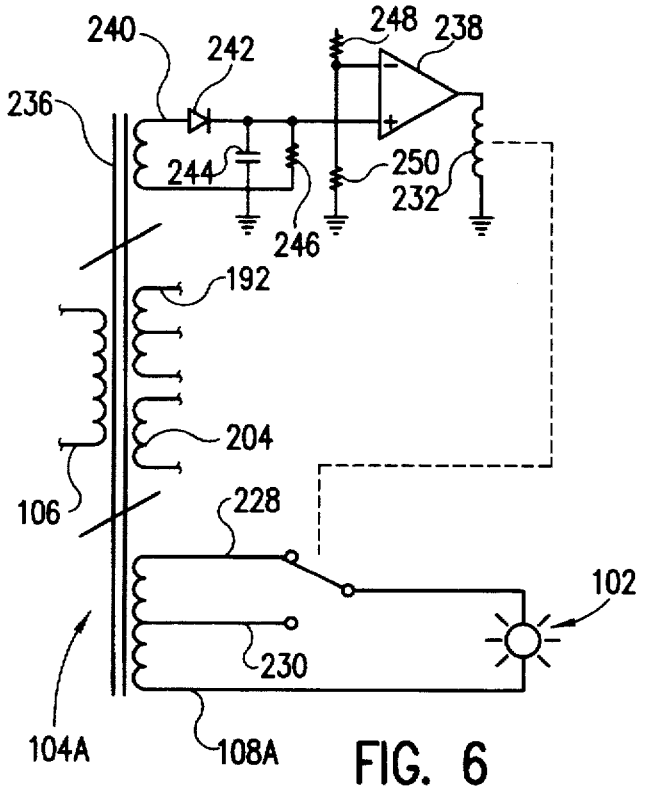
FIG. 6 a schematic diagram of modifications of FIG. 1 for configuration of an alternate embodiment of the ballast circuit of the present invention.

While correction of the triangular current waveform was by resonant operation in the illustrative embodiment of FIG. 1, in the embodiment of FIG. 6, correction is performed by switching out a large part of the inductance, i.e. the secondary winding, after load application, such as by the ignition of a lamp. Such switching removes much of the inductance in series with a lamp at the load position 102 and provides a more square drive current waveform at the output stage. To this end, the secondary winding 108A includes a first tap 228 and a second tap 230. A relay comprising a coil 232 and a controlled contact 234 selects either the first tap 228 for starting or the second tap 230 for running.

The operated/released state of the relay is determined by sensing the flux level in the secondary flux path 110 defined by a section 236 of the transformer core which includes the control air gap 114 as shown in FIGS. 2–5. As the flux density increases above a preset level, the relay driver 238 operates the relay to switch to the running or second tap 230 to continue operation. As shown in FIG. 6, a sense winding 240 is coupled to the core section 236. Before application of a dynamic load, little flux flows in the core section 236; however, after loading, substantial flux flows to thereby induce an activating voltage level in the sense winding 240. The resulting AC voltage is rectified by a diode 242 and filtered by a parallel combination of a capacitor 244 and a resistor 246. The relay driver 238 comprises a comparator which operates the relay when the voltage generated by the sense winding 240 exceeds a threshold voltage defined by resistors 248, 250.

By switching out a section of the secondary winding 108A, and thus reducing the inductance connected in series with the load 102, the current waveform will take on a square shape such that the power throughput for a given maximum transistor peak current is nearly 60% greater.

In another aspect of the present invention, the AC power line input, as shown in FIG. 1, is configured to protect the ballast circuit against one catastrophic power transient. As shown, a first varistor 252 is connected across the line in series with a fuse 254, a first inductor 256 and a zig-zag foil film section 258 preferably formed as a part of a printed circuit board, but not in series with a second inductor 260. A second varistor 262 is connected across the line in series with the fuse 254, and both inductors 256 and 260. Accordingly, the second varistor 262 has a higher impedance in series with it than the first varistor 252 such that the first varistor 252 will first engage any transient energy appearing on the input for the AC line power.

If the transient energy is sufficiently high so as to be catastrophic for the ballast circuit 100, the transient current will burn off the zig-zag foil film section 258 as it is diverted by the first varistor 252 which greatly enhances the energy dissipation ability for the one time occurrence. After the occurrence of such a catastrophic transient, the second varistor 262 remains intact to act in a more traditional protection manner.

The system has general applicability to dynamic loads as a power supply, as well as to discharge lamps. FIGS. 17–22 show additional embodiments.

Figure 17:
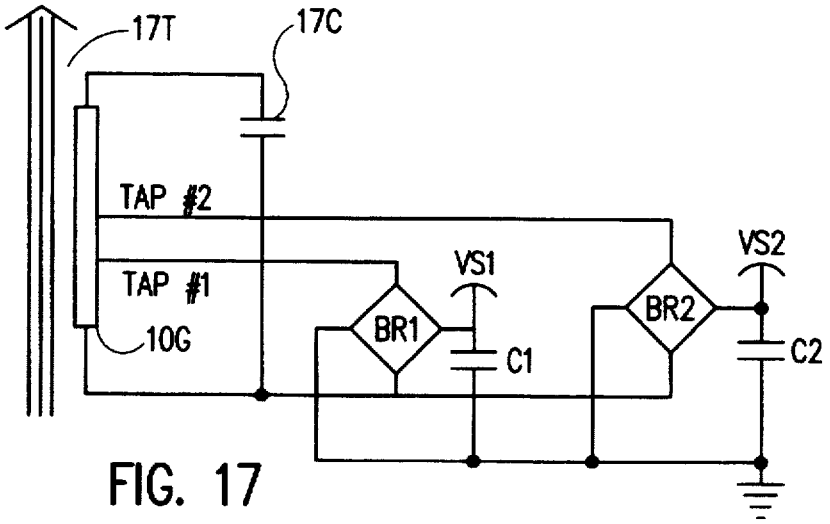
In FIG. 17, the transformer indicated at 17T is as otherwise described herein and includes winding 106 with additional taps. The resonating capacitor is shown at 17C.
Figure 18A:
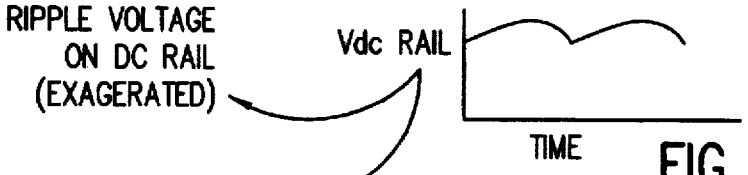
FIG 18A an exaggeration for purposes of illustration and explanation and depicts the waveform of the ripple voltage on the DC rail.
Figure 18:
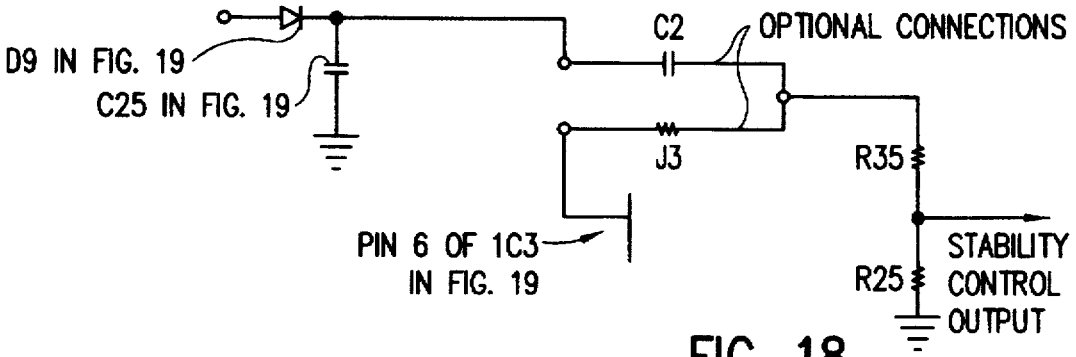
FIG. 18 is a detail of the stability network showing pertinent interconnections with the circuit components of FIG. 19.

To provide for a regulated output voltage, the secondary 108 in FIG. 17 is resonated without the load or lamp in place. This will provide a constant volts-per-turn when the unit is operated as described in the main embodiment described above. FIG. 17 is a typical power supply configuration where there is a need for multiple voltage output configuration. A tap of winding 108 is selected to provide the proper voltage output after rectification by bridge rectifier BR1 and BR2, and filtering by C1 and C2 respectively. The use of two sources here is illustrative and does not imply in any way that two is a limit of the number of sources. Determined by design, need, or predetermined application. There could be any number of taps and sources. Regulation over any load variation is provided by the very low impedance looking back into the secondary, which is in the order of 1 to 10 milliohm. To compensate for bridge input voltage variation, each tap is therefore regulated by the frequency modulation that occurs. However, each source is regulated not by compensation with the excess voltage that would be applied to an analog regulator, as in an ordinary power supply, but rather by making the internal voltage source invariant and very low impedance. For example, in a computer power supply, this not only allows a volt +5 high current source, but also enables the auxiliary voltage sources to draw high power without reducing efficiency or increasing physical size.

Figure 19:
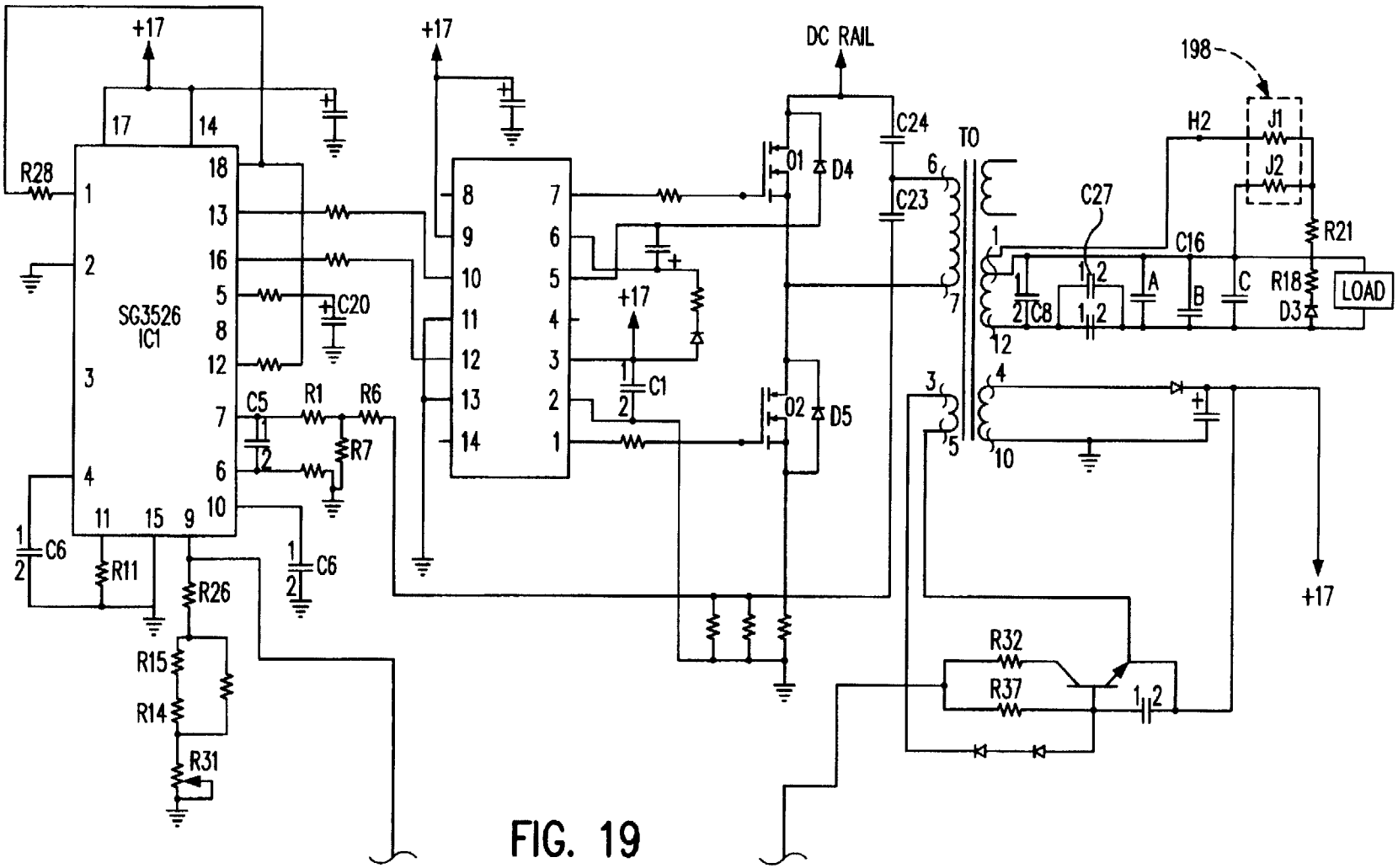
FIG. 19 depicts a load ballasting circuit including the active power factor correction circuitry identified within the box marked 19A. In the box identified by 198, J1 is used for HPS (high pressure sodium lamps ) only; J2 is used for MH (metal halide lamps) only. The DC coil and chassis ground connections of the circuit segments are likewise indicated. In the power input segment of the circuit relay RY1 and capacitors C11, C13, and C14 and resistors R20, R22, R23, R34, R32 and R37 have values determined by the line voltage. Values for other components are dependent on load wattage, and/or type of lamp, if the circuit is so utilized.
Figure 19A:
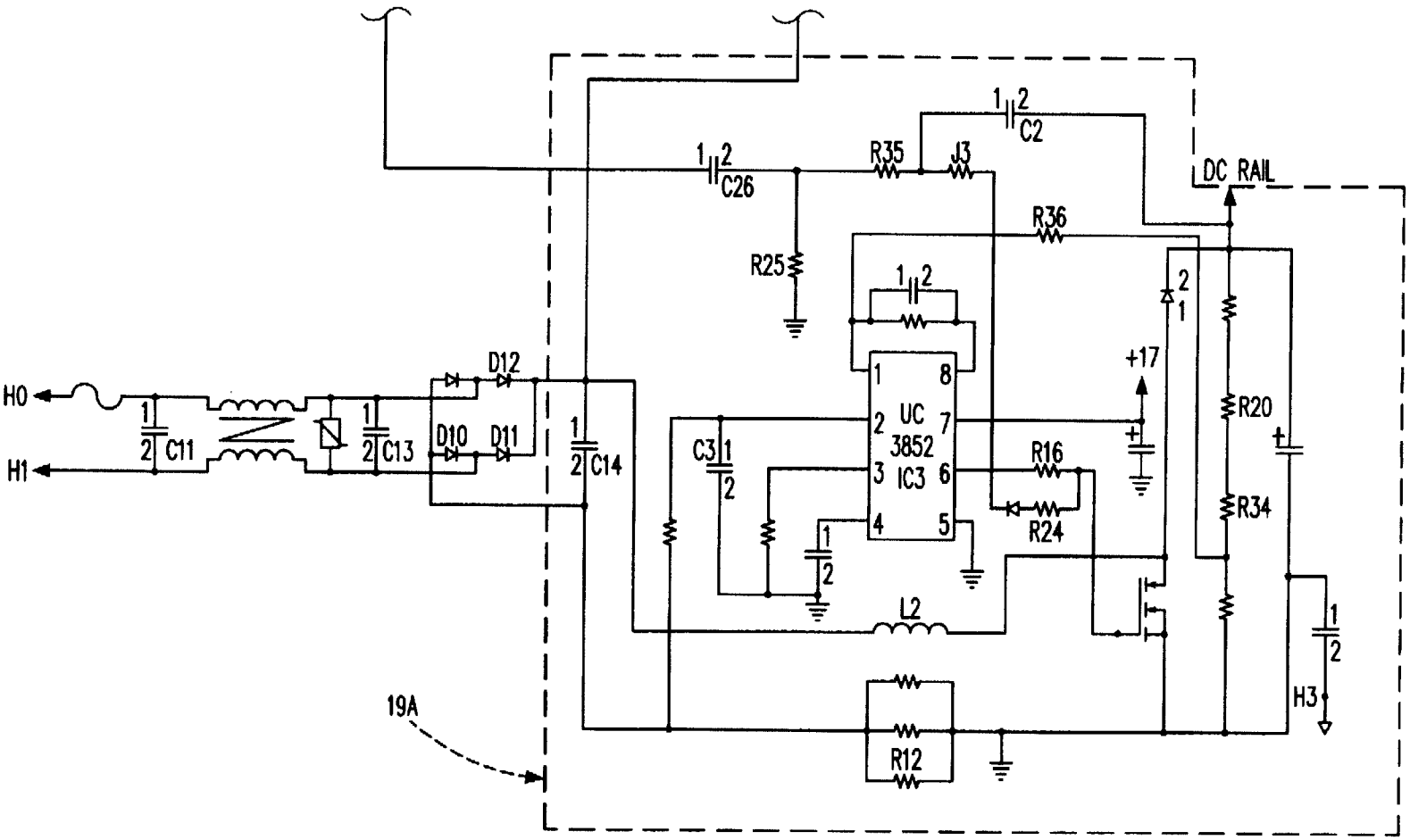

An alternative start up circuit is shown in FIG. 19 which corresponds to the functional drawing shown on FIG. 22. When the circuit is not active and voltage is applied at $V_{in}$, transistor Q9 is biased on by the current induced in resistor $R_{start}$. This bias current is referred to as $I_{in}$. Q9 is driven into saturation and current flows in $R_{start}$ to initialize the operation of the circuit. When the bridge becomes active winding $W_{new}$ will now have an induced voltage that will set up a voltage source that will negate the bias current into the base of Q9. The base emitter will not be reverse biased. The winding is adjusted so as to prevent the base emitter from being driven into a zener mode. Q9 is removed from conduction and the transistor is now turned off and current no longer flows in $R_{start}$. This terminates the initialization or start-up sequence. The direct current offset ignition circuit is composed of elements C16A, C16B, C16C, C27, C12, C8, D3, R18, R21, J1, J2 in FIG. 19.

Figure 21:
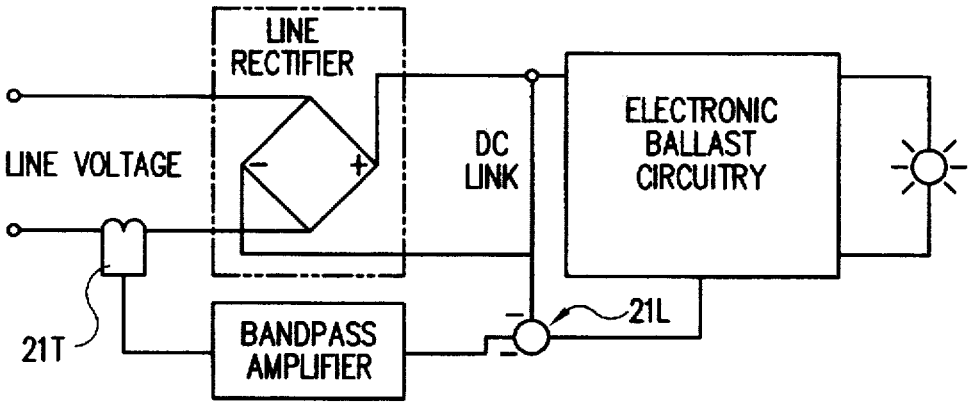
FIG. 21 is a simplified block diagram of the dynamic harmonic capture circuit showing a current transformer at 21T for sampling line current and the control line 21L connected through a bandpass amplifier to a DC line between the line rectifier and ballast circuit to adjust for the average DC level.
Figure 21A:
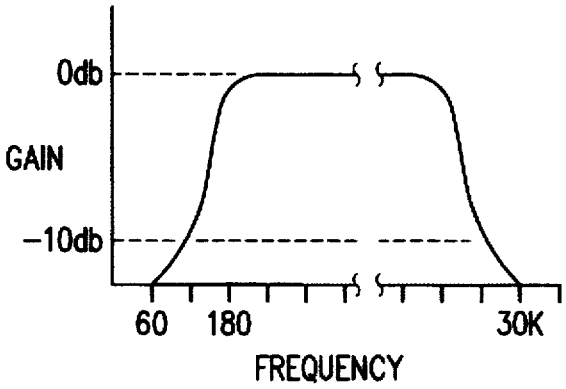
FIG. 21A shows the frequency gain and bandpass of the line current amplifier shown in the block diagram of FIG. 21.

As heretofore explained, one embodiment of the circuit uses an internally generated voltage source to improve the overall power factor of the circuit; however, the internal source generates a high level of harmonics on the line. Certain markets and applications require that the power factor be better than 96% and the THD lower than 30%. A circuit configuration called the Dynamic Harmonic Consultation circuit (DHC) overcomes this problem of harmonics generation. This configuration is an "integrated topology" because the same power output stage that drives the output transformer is also responsible for power factor correction and harmonic control, in contrast with a circuit that uses a separate circuit that corrects first for line dynamics and a second that provides the ballast or power supply function.) FIG. 21 is a block diagram of DHC configuration.

Figure 20:
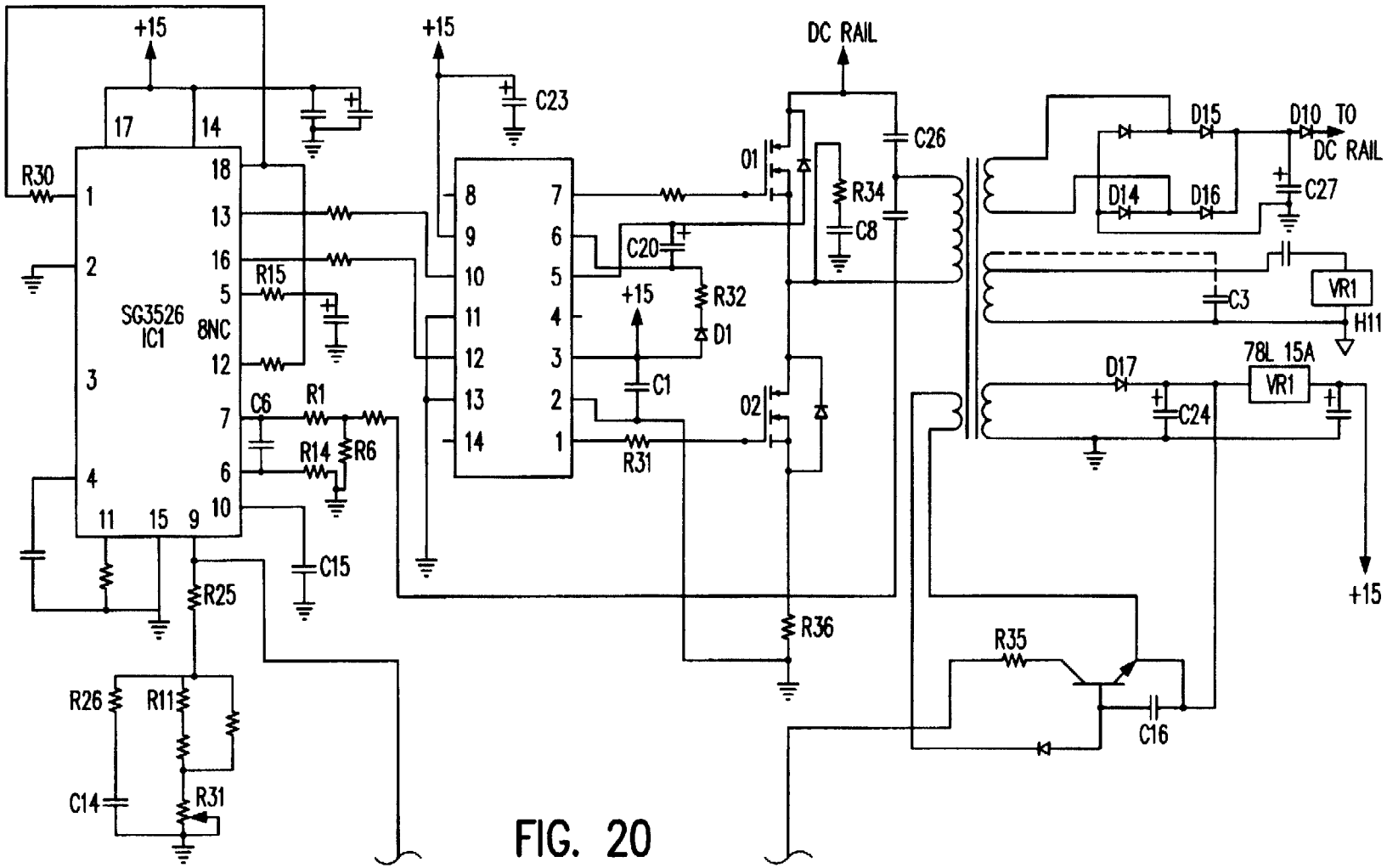
In FIG. 20, the dynamic harmonic cancellation circuit is indicated inside the dotted box identified as 20A. The diode D12 is optional and need not be used in certain applications. Connections of the circuit signals to the DC rail are also indicated.
Figure 20A:
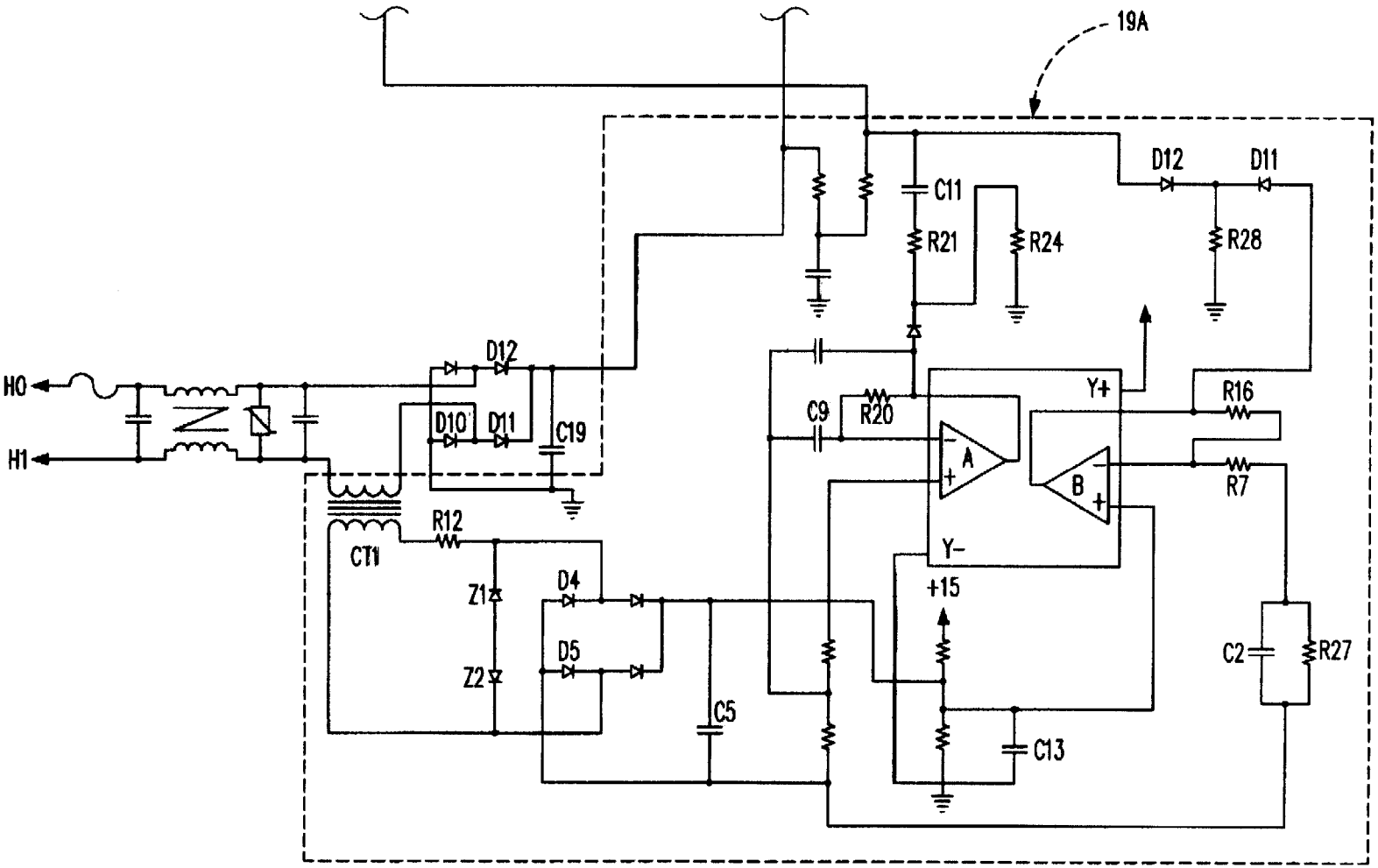

In FIG. 20, current transformer CT1 samples the line current that is then fed into a bandpass-limiting circuit to ensure that very little of the 60 hertz signal passes through. The phase of the remaining harmonics are then fed into a summing junction that sums the control signal that also compensates for the average level of the DC rail and the phase-inverted harmonics. The bandpass-limiting can be as simple as a first order RC filter or a more precise second order active filter. The ideal bandpass is shown in FIG. 21.

In theory, none of the 60 Hertz energy would pass the filter. Practically, though, some of the fundamental harmonics do pass through, and this proves to be the limiting factor for the effectiveness of the DHC. This method is far more effective because the output stage is the load on the rectified line input. The way the output stage draws current is modified so as to not create harmonics on the line that would then be captured by the input sampling circuit. The harmonics that are present are actually the error signal in the control loop. They are, however, quite small and correction to less than 14% THD has been demonstrated.

A circuit embodying the high frequency electronic ballast of the iniation and achieving DHC is shown in FIG. 20. The components in the blocked area are those responsible for DHC. Current transformer CT1 samples the line current with full fidelity of harmonics. R12, Z1 and Z2 provide for pulse limiting during startup and other transient line conditions. Diodes D4, D5, D9 and D8 mirror the input rectifiers' offsetting effect on the harmonics. Capacitor C5 reduces noise signals above the desired capture frequency. C9, C10 and R20 configure the op-amp's bandpass as specified earlier. The output of this amplifier is taken at pin 1. D10,R21 and R24 allow the control signal to be asymmetric and improve the overall performance of the DHC.

Other than the reduction of harmonics, the DHC also provides a more precise control voltage for compensating the output voltage at the load.

In certain embodiments, a notching of the input line current occurs as the sine function nears the zero cross point. This interval of time also sees a large ripple voltage on the DC rail that is compensated for by a frequency shift that results in an elimination of that ripple in the secondary output. An improvement of this function is achieved by the circuit shown in the blocked area of FIG. 20. This improvement speeds up the response time of the ripple compensation. In FIG. 20, R7 and R16 set up a high gain in amp B of the dual op-amp shown. R27 and C2 improve the rise and fall time of the resulting control signal. The resulting output is a square wave that occurs during the line notch. Diode D12 and D11 isolate the oscillator input when the op amp output is high. When the line notch occurs the op amp goes low and the voltage across R28 drops below the anode voltage of D12. Diode D12 forward biases and effectively connects R28 to the oscillator input resulting in an increase in frequency and the levelling of the secondary voltage.

Another variation of the circuitry utilizes a standard boost-topology power factor correction. A variation of the circuitry, especially when applied as a ballast for discharge lamps, is seen in FIG. 19. Here the ballast uses a commercially available active power factor corrector circuit, UC3852, for power factor correction and reduction of line harmonics. The operation of this circuit is precisely as described by the manufacturer in the application sheets. The functional change in this variation is the introduction of a frequency modulation that is not an inherent part of the normal ballast operation. This is introduced by components C26, R25, R35, C2 and J3 (a jumper makes this connection optional). In normal operation, there is an always an amount of ripple. Although this ripple is very low as compared to the overall voltage level, it is more than enough to introduce a significant deviation of frequency when used at the frequency control input. Capacitor C2 couples the ripple portion of the DC rail into voltage divider composed of R35 and R25. The attenuation can be modified for particular stability and lamp geometry by this divider. The deviation introduced is a smooth variation occurring at twice the line frequency.

A second type of variation can be introduced by placing jumper J3 instead of coupling capacitor C3. This connects the attenuated signal to the UC3852 drive output. The drive output has a frequency shift predicated on power throughput and line cycle variation. This frequency provides a randomizing effect of the main ballast frequency which is preferred by some lamp geometries. A third deviation strategy is to use both smooth and randomized together. The connections are further exemplified in FIG. 18.

Having thus described the invention of the present application in detail and by reference to the preferred embodiments thereof, it will be apparent that modifications and variations are possible without departing from the scope of the invention defined in the appended claims.

What is claimed is:

1. A ballast circuit for igniting and operating a discharge lamp, the circuit comprising:

a transformer having a primary winding and a variable flux linked secondary winding connected to a discharge lamp, said primary winding being connected to a driver circuit, said secondary winding being connected in series with said lamp through a capacitor having a capacitance such that a first resonant circuit having an essentially zero reactance with respect to said lamp results after ignition of said lamp;

a driver circuit connected to said primary winding for driving said transformer at a sufficiently high frequency to initiate and to maintain a stable arc in the operation of said lamp connection to said secondary winding;

an ignition circuit including a direct current offset circuit and a second resonant circuit, said ignition circuit being connected between said transformer and said lamp;

said second resonant circuit establishes a resonance at one of the harmonics of said second resonant circuit prior to ignition of said lamp; and said direct current offset circuit applies a non-oscillatory voltage to said lamp in combination with an oscillatory voltage applied to said lamp by said second resonant circuit;

wherein said combination of oscillatory and non-oscillatory voltages applied to said lamp reduces the voltage otherwise required for ignition of said lamp.

2.The circuit of claim 1 wherein said direct current offset ignition circuit comprises a series connection of a resistance and a diode in parallel with the discharge lamp.

3. The circuit of claim 1 wherein said transformer has a gap that controls the coupling strength between the primary and secondary windings such that the flux in the secondary winding provides substantially constant power regardless of the lamp variations.

4. The circuit of claim 1 wherein said transformer comprises a primary flux path coupling said secondary winding to said primary winding and a secondary flux path having a higher magnetomotive force drop than said primary flux path.

5. The circuit of claim 2 further including a capacitance connected in parallel to the resistor and diode.

6. The circuit of claim 4 wherein said secondary flux path includes a gap to define said higher magnetomotive force drop.

7. The circuit of claim 6 wherein said gap is adjustable to enable selection of said higher magnetomotive force drop in said secondary flux path.

8. The circuit of claim 6 further comprising an auxiliary gap adjacent at least a portion of said primary winding.

9. The circuit of claim 1 further comprising means connected to said secondary winding for defining the resonance of the circuit.

10. The circuit of claim 9 wherein said means comprises a series resonant capacitor connected in series with said secondary winding and a lamp for defining a series resonance frequency during operation of a connected lamp.

11. The circuit of claim 10 wherein said means further comprises a shunt resonant capacitor connected in shunt across a connected lamp for defining a shunt resonance frequency while a connected lamp is extinguished.

12. The circuit of claim 10 wherein said driver circuit comprises oscillator means for setting an operating frequency for said driver circuit.

13. The circuit of claim 12 wherein said oscillator means is operated at a substantially fixed frequency.

14. The circuit of claim 12 further comprising frequency control means for setting an operating frequency for said oscillator means.

15. The circuit of claim 14 wherein said frequency control means comprises a frequency control signal source generating a frequency control signal to vary said operating frequency for said oscillator means about a given operating frequency, whereby a stable arc in the lamp is ensured at said given operating frequency.

16. The circuit of claim 14 wherein said frequency control means comprises manually adjustable circuitry connected to said oscillator means.

17. The circuit of claim 14 further comprising alternating current to high voltage direct current converter means for generating high voltage direct current power for said driver circuit, and wherein said frequency control means comprises a feedback loop from said converter means for varying said frequency of operation of said oscillator means as a function of variations in said high voltage direct current power.

18. The circuit of claim 17 wherein said frequency control means further comprises a frequency control signal source generating a frequency control signal to vary said operating frequency for said oscillator means about a given operating frequency whereby a stable arc in the lamp is ensured at said given operating frequency.

19. The circuit of claim 1 further comprising a power supply for generating full-wave rectified power from a supply of alternating current power, said full-wave rectified power being supplied to said driver circuit.

20. The circuit of claim 19 wherein said power supply comprises transient protection means for protecting said power supply from a power surge.

21. The circuit of claim 20 wherein said transient protection comprises:

a first varistor designed to protect against voltage surges exceeding a first defined voltage level;

fusible circuit means for suppressing transient events caused by power surges opening at current levels above a first current level, said first varistor and said fusible circuit means being connected in series with the series combination being connected in shunt across an input for said supply of alternating current power; and a second varistor designed to protect against voltage surges exceeding a second defined voltage level greater than said first defined voltage level, said second varistor being connected in shunt across said input for said supply of alternating current power.

22. The circuit of claim 21 wherein said fusible circuit means comprises a section of electrically conductive foil on a printed circuit board.

23. The circuit of claim 21 wherein said electrically conductive foil is formed in a zig-zag pattern having a modulating effect on current.

24. The circuit of claim 1 further including a boost-topology power factor correction circuit.

25. The circuit of claim 19 further including a boost-topology power factor correction circuit.

* * * * *